US008128453B2

(12) United States Patent
Kamar et al.

(10) Patent No.: US 8,128,453 B2
(45) Date of Patent: Mar. 6, 2012

(54) WEIGHTED STUFFED ANIMAL

(76) Inventors: Christopher Kamar, Palos Verdes Estates, CA (US); Joy Kamar, Palos Verdes Estates, CA (US)

( * ) Notice: Subject to any disclaimer, the term of this patent is extended or adjusted under 35 U.S.C. 154(b) by 216 days.

(21) Appl. No.: 12/583,701

(22) Filed: Aug. 24, 2009

(65) Prior Publication Data

US 2010/0056018 A1 Mar. 4, 2010

Related U.S. Application Data

(60) Provisional application No. 61/190,322, filed on Aug. 28, 2008.

(51) Int. Cl.
*A63H 3/02* (2006.01)

(52) U.S. Cl. ..... 446/370

(58) Field of Classification Search ..... 446/370, 446/397

See application file for complete search history.

(56) References Cited

U.S. PATENT DOCUMENTS 4,296,567 A * 10/1981 Kamar ..... 446/369
5,975,982 A * 11/1999 Spector ..... 446/397

* cited by examiner

*Primary Examiner* — Gene Kim
*Assistant Examiner* — Michael Dennis
(74) *Attorney, Agent, or Firm* — The Hill Law Firm PLC; Scott A. Hill

(57) ABSTRACT

A figure toy has a body, characterized by a head and torso, with a fabric covering that is at least partially filled with a stuffing material. A plurality of appendages with a fabric covering, which may include contact pads, are substantially unfilled except that the ends are partially filled with a first particulate material that is preferably in a bag that is sewn to the fabric covering of the appendages. Additionally, a second particulate material that may also be sewn into a bag is preferably sewn to a seam of the torso that normal includes a tag or label.

2 Claims, 2 Drawing Sheets

WEIGHTED STUFFED ANIMAL

RELATED U.S. APPLICATION DATA

This application claims the benefit of priority of U.S. Provisional Application No. 61/190,322, filed on Aug. 28, 2008, and titled "Weighted Stuffed Animal", incorporated herein by reference in its entirety.

BACKGROUND OF THE INVENTION

Figure toys, such as stuffed animals and dolls, remain popular for play and display by both children and adults. The ability to manipulate the pose of a figure toy is often a valuable feature that enhances the enjoyment and functionality of the figure toy. As shown and described in U.S. Pat. No. 4,296,567, incorporated herein by reference but not by limitation, Pascal Kamar developed a figure toy having flexible appendages. A Kamar stuffed animal's simulated arms and legs, which were manipulatable, were attached to a relatively light weight torso. The ends of each flexible appendage had weight that provided a holding capability. As can be seen in the various figures of the Kamar patent, a figure toy could be suspended by the ends of flexible appendages resting on or over a support member, such as a ledge.

SUMMARY OF THE INVENTION

The present invention is an improvement to the Kamar figure toy's construction that expands and enhances the available configurations a figure toy can maintain. By uniquely altering the construction of the torso, a figure toy that otherwise has flexible appendages with weighted ends (hands/feet/paws) can support itself in an upright position when seated on a support member, such as a ledge or floor. We added an easily deformable bag of particulate filler to the inferio-dorsal region of the torso using plastic pellets that are about half the density of the particulate filler inserted into the end of an appendage. Preferably, a pellet bag is sewn to a seam of a fabric covering (simulated fur, skin or clothing) of the toy figure adjacent any tags or labels sewn to the toy; the label providing a good backing material that prevents the seam of the fabric covering material from unraveling if the weight of the pellet bag pulls against the seam.

In an alternate preferred embodiment, a figure toy according to the present invention can sit upright on a ledge, even if all of the appendages with weighted ends are allowed to dangle over the ledge, and the toy will maintain that configuration because of our alternate improved torso construction. The alternate preferred embodiment is characterized by a flattened pelvic girdle that provides a broadened seating surface, thereby providing added upright stability. The flattened pelvic girdle also allows for a larger pellet bag to be sewn to the inferio-dorsal region, thereby adding additional mass and deformability. The resulting lowered center of mass of the torso, along with the increased surface area at the base of the torso, prevents the alternate preferred embodiment from being easily pulled over a ledge by the weight of all of the appendages.

Figure 1:
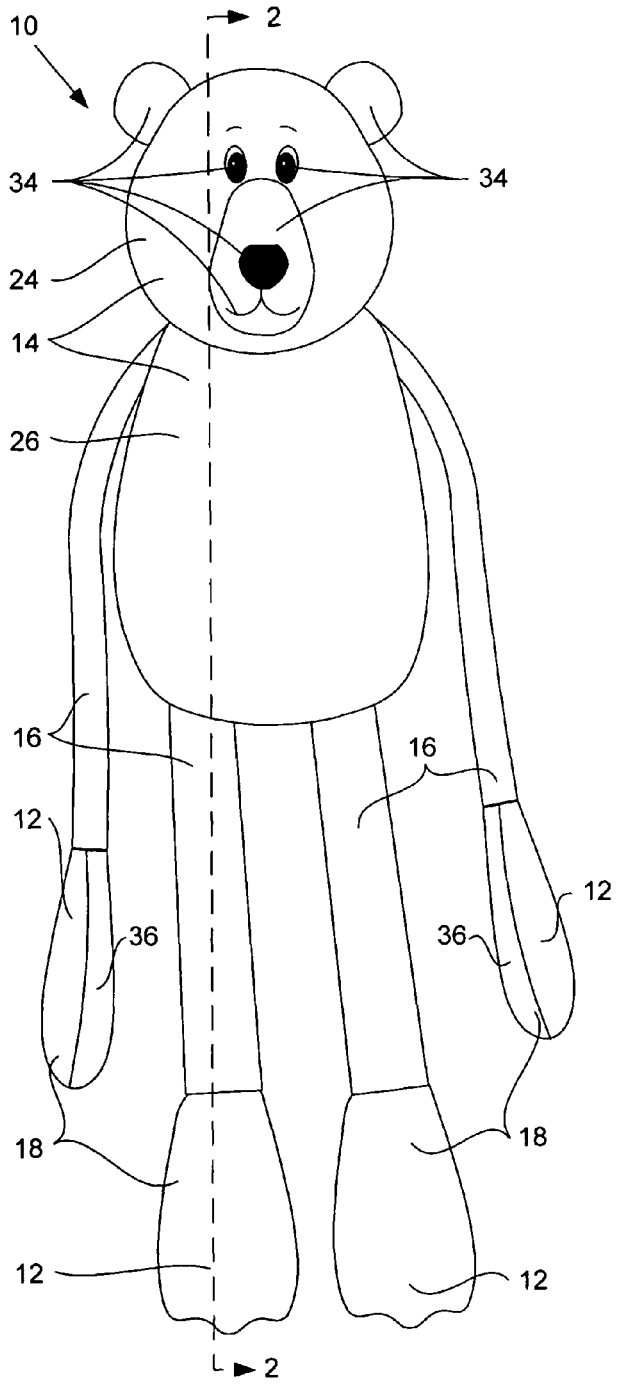
FIG. 1 is a front perspective view of a figure toy according to the present invention.

The following is the list of numerical callouts used in FIGS. 1-4:

10 figure toy
12 fabric covering
14 body
16 appendages
17 opening
18 end
19 seam
20 particulate material
22 appendage's particulate bag
24 head
26 torso
28 stuffing material
30 inferio-dorsal region
34 external features
36 contact pads
38 longitudinal seams
40 rear quarters
42 label
44 torso's particulate bag
46 particulate material

DETAILED DESCRIPTION OF THE INVENTION

A figure toy 10 according to the present invention, such as a toy animal, has a fabric covering 12 that is selectively filled with various materials to achieve a desired flexibility and weight distribution. The most preferred embodiment of the present invention, shown in FIGS. 1 through 4, is a figure toy or doll, such as a stuffed animal, having a body 14 and appendages 16. The appendages are substantially unfilled, except that the end 18 of each appendage is at least partially filled with a mass of particulate material 20 contained inside an appendage's particulate bag 22, such as a mesh bag containing plastic beads. The body, which is characterized by a head 24 and torso 26, is substantially filled with a soft stuffing material 28, such as a resilient pillow stuffing material. The torso is uniquely characterized by the inferio-dorsal region 30 being at least partially filled with a mass of particulate material. The particulate material in the end of an appendage is smaller and denser than the particulate material in the torso, as will be explained later. Preferred materials, shapes and methods of assembly will be discussed, but these preferences are not intended to exclude suitable or functionally equivalent alternatives.

The head 24 of the body 14 is covered with a soft fabric covering 12, except where there are overlying external features 34 such as eyes, ears, a nose and mouth. External features may be simulated using stitching, or by fastening material or an object that represents an external feature. The fabric covering of the head can be simulated fur, simulated skin and/or a simulated article of clothing. Preferably, the head is filled with a soft and resilient stuffing material 28 that is relatively light weight, such as a polyester pillow stuffing. To create contrast, a relatively large external feature, such as a snout, can be filled with a different stuffing material, such as foam.

The appendages 16 of a figure toy 10 typically include two or more legs. Any other appendages are usually arms and/or a tail. The appendages shown in the various figures represent the four legs of a bear. The appendages are formed by sewing a soft fabric covering 12, sometimes similar to that used to cover the head 24, to form a tube of simulated fur, simulated skin or clothing. The appendages are not filled or otherwise stuffed to allow the appendages to be manipulated and contorted into a much broader range of positions. Because the appendages are not stuffed, they will often assume a flattened appearance. Arms, or forward most legs, should be sewn into the seam between the head and torso 26 such that the broadest surface of such an appendage is facing to a side of the toy figure, as most clearly seen in FIG. 3. Rear most legs should be sewn to the bottom of the torso such that the broadest surface of such an appendage faces the front or rear of the toy figure, as most clearly seen in FIG. 1. There are no particular limitations to the orientation of a tail or other optional appendage, which may or may not be stuffed.

Figure 2:
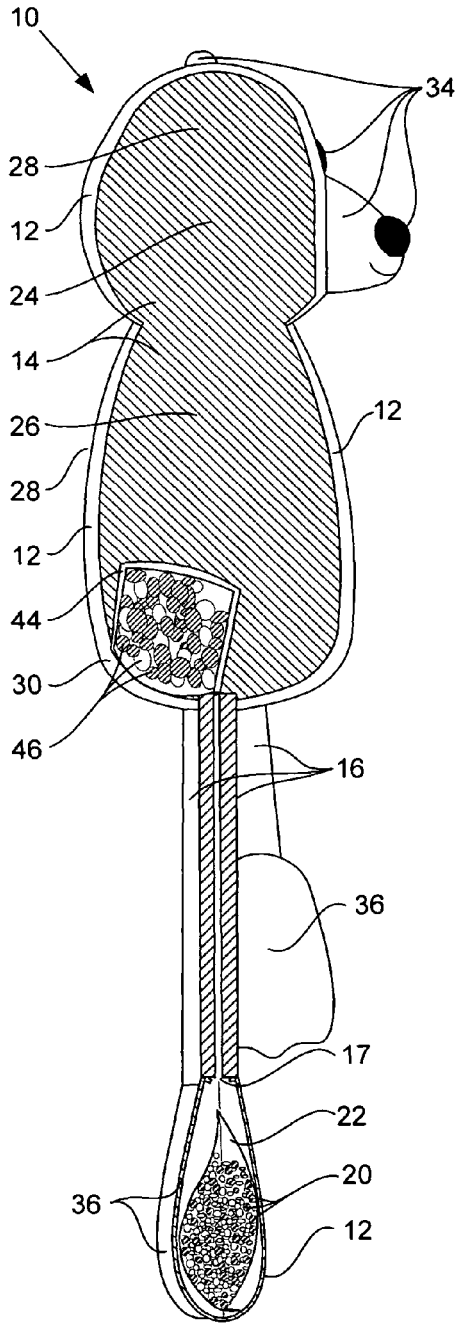
FIG. 2 is a cross section through line 2-2 of FIG. 1.
Figure 3:
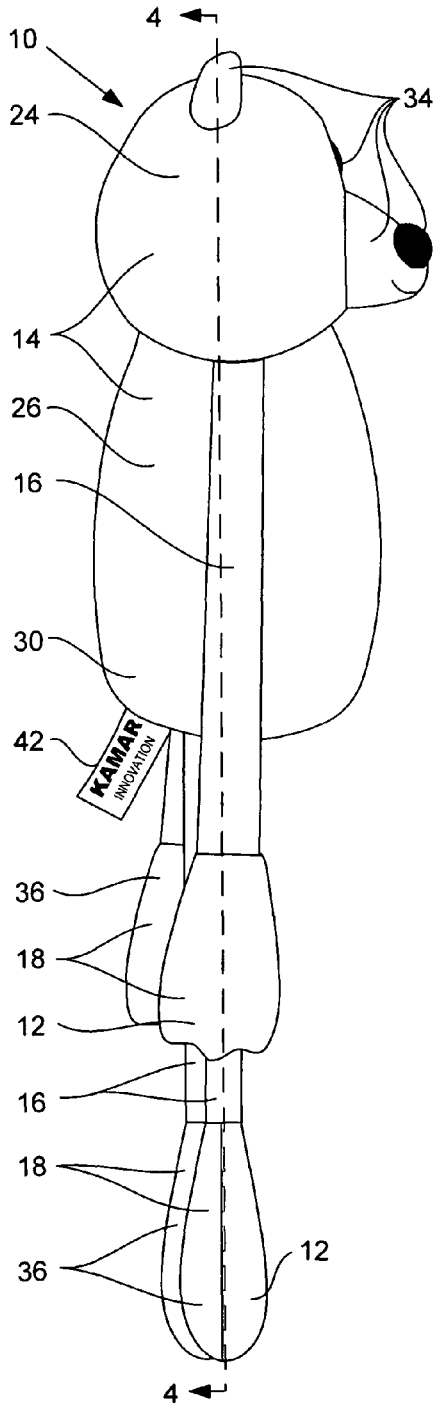
FIG. 3 is a side perspective view of the figure toy of FIG. 1.
Figure 4:
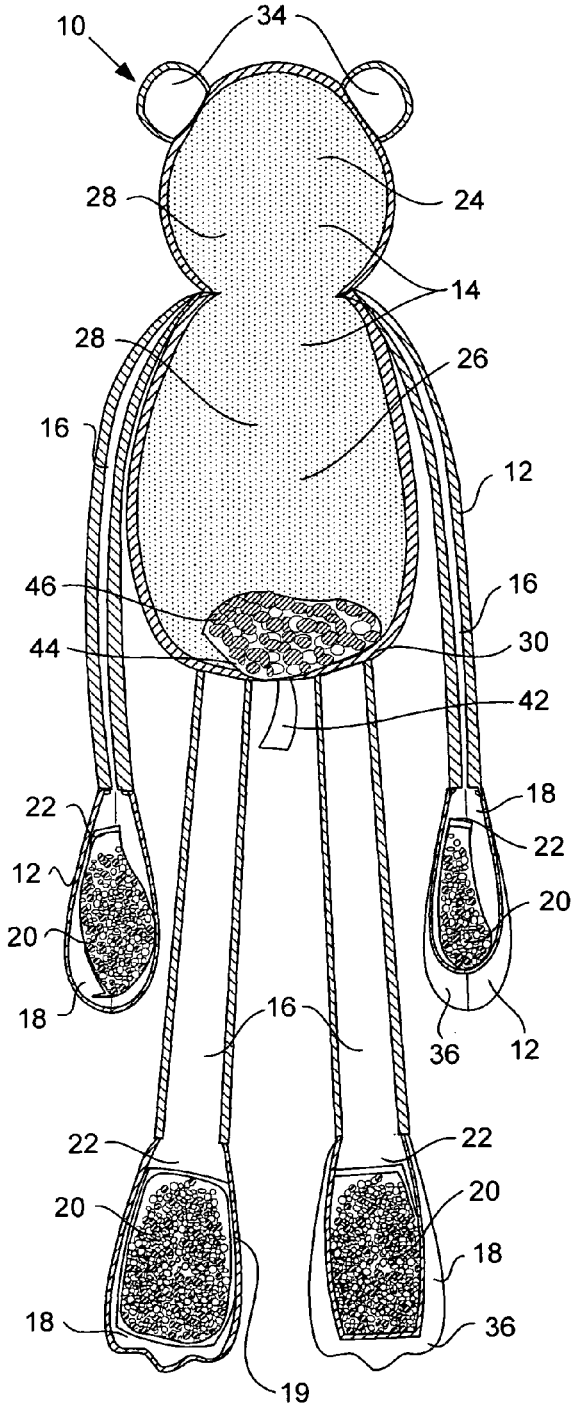
FIG. 4 is a cross section through line 4-4 of FIG. 3.

The end 18 of each appendage 16, most particularly any simulated hands, feet or paws, are also fabricated from a soft fabric covering 12. There is an opening 17 between the end of each appendage and the tubular portion of each appendage, as shown in FIG. 2, so the ankles and wrists do not appear flattened relative to the ends of the appendages. (Prior art devices ran stitching across an ankle or wrist to prevent a pellet bag from moving into another portion of a toy figure.) The ends of the appendages are partially stuffed with a particulate material 20 filler contained inside of an appendage's particulate bag 22, more particularly a flexible pellet-filled bag. The bag is most preferably made from a smooth mesh material that allows the particulate material to move about freely inside the bag. At least a portion of the bag is sewn adjacent a seam at or near the end of an appendage, such as along seam 19 on a hand, foot or paw, as shown in FIG. 4. This seam is used to keep the bag near the end of the appendage. The particulate material for the ends of the appendages is preferably plastic pellets having a relatively small diameter, but not so small such that the pellets can't be contained by the bag. Approximately 30 grams (~1 oz) of about two millimeter average diameter pellets is preferred to create a desired flow of the particulates. The specific gravity of the particulate material used in the ends of the appendages is preferably greater than one. No other filler material or stuffing is needed inside the ends of the appendages.

The ends 18 of the appendages 16 are additionally characterized by contact pads 36 on the plantar side of the simulated feet, and, if present, the palmar side of the simulated hands. The dorsal side of the simulated feet and/or hands can be any of the previously mentioned fabric materials, such as simulated fur. The contact pads are most preferably a flexible vinyl material, such as a vinyl polyurethane, or other simulated skin. Particularly because of static frictional forces, a contact pad lends additional holding capability to the end of an appendage, in addition to the holding capability provided by an appendage's particulate bag 22.

The various appendages 16 and the head 24 are at least partially sewn to the torso 26 of the body 14. The torso is filled with a relatively light weight stuffing material 28, similar to that used in the head. The stuffing material in the head can communicate with the stuffing material in the torso. The torso is covered with any suitable fabric covering 12 that simulates fur, skin and/or clothing. Preferably, the torso will be egg shaped, despite whether that shape is a characteristic of the animal being simulated, to improve the posturing ability of the figure toy. To make an egg shaped torso, longitudinal seams 38 are used to splice together the fabric covering of the torso, which is preferably characterized by two rear quarters 40 and either two front quarters or a front half. The seam shared by the two rear quarters generally runs where the spine of the simulated animal would be located. The bottom of this seam, near the inferio-dorsal region 30 of the torso, is the designed location to add a label 42 and/or manufacture's tag to the figure toy by sewing the label to the longitudinal seam. Because the label material is usually stronger than simulated fur and the like, the label provides a good backing material for more securely holding thread. This strengthened length of seam is used to secure the torso's particulate bag 44 inside the inferio-dorsal region of the torso.

The torso's particulate bag 44, located at the inferio-dorsal region 30, is designed to add mass to the torso 26 such that the center of gravity of the body 14 is repositioned more inferiorly. This bag, filled with particulate material 46, also increases the deformability of the inferior pelvic region of the torso. In order to maintain a desired weight balance while producing a highly deformable inferior pelvic region, the particulate material 46 used for the torso is preferably larger diameter plastic pellets, such as about 4 mm average diameter, that are considerably less dense than the particulate material 20 used in the appendages. Adding too much weight to the torso will negatively affect the ability of the figure toy to be suspended by its appendages. The specific gravity of the plastic or other material used to make the pellets used in the torso is less than one, preferably about half the specific gravity of the particulate material used to make the appendages. In the exemplary embodiment, shown in FIGS. 1-4, the weight of the torso's particulate bag is about 30 grams (1 oz), about the same as the weight of an appendage's particulate bag, even though the volume of the torso's particulate bag is much greater than that of an appendage's particulate bag.

The torso's particulate bag 44 adds mass to the inferio-dorsal region 30, and the resilient stuffing material 28 in the torso 26 tends to distend the anterior pelvis, both lending stability and helping to prevent the figure toy from tipping forward. Because it is often desirable to posture a figure toy in a forward-facing position, it is most common for the appendages to be toward the front of the figure toy such that the weight of the appendages prevents the figure toy from tipping backwards. The deformability of the torso's particulate bag allows the torso to be manipulated and contorted enough to establish a stable configuration that is less likely to tip in any particular direction.

An alternate preferred embodiment uses essentially the same structure as the exemplary embodiment except that the torso's particulate bag 44 is much heavier, at least twice as heavy as an appendage's particulate bag 22. Also, the dorsal region of the torso 26 is broader to accommodate the larger particulate bag. The added weight makes it difficult to suspend the figure toy 10 by appendages 16, but the ability to easily posture the figure toy in a seated position is much better. For some characters, this trade-off is desirable. The appendages remain very flexible, so the ability to contort the appendages into amusing positions remains a dominant characteristic of the figure toy.

While a preferred form of the invention has been shown and described, it will be realized that alterations and modifications may be made thereto without departing from the scope of the following claims.

What is claimed is:

1. A figure toy comprising:

a body, characterized by a head and torso, with a fabric covering that is at least partially filled with a stuffing material;

a plurality of appendages with a fabric covering that is substantially unfilled, each appendage being characterized by an end portion that is partially filled with a first particulate material;

a bag filled with second particulate material that is at least partially secured to an inferio-dorsal region of the torso;

wherein the first particulate material is contained in a bag;

wherein the weight of second particulate material located in the torso is at least twice the weight of first particulate material located at the end portion of one of the appendages; and wherein the covering of the torso is characterized by a longitudinal seam that at least defines two rear quarters, and wherein the longitudinal seam that joins the two rear quarters also joins a tag and/or label near the inferiodorsal region of the torso;

wherein the bag containing the second particulate material is fastened to the longitudinal seam adjacent the tag and/or label; and wherein the second particulate material of the torso 10 provides a holding capability whereby the figure toy can be supported or suspended from a surface by way of the torso having engagement with the surface, said torso having sufficient weight to hold the figure toy suspended.

2. The figure toy of claim 1 wherein an average particulate size of the second particulate material is at least fifty percent larger than an average particulate size of the first particulate material.

* * * * *